US007975872B2

(12) United States Patent
Lardino

(10) Patent No.: US 7,975,872 B2
(45) Date of Patent: Jul. 12, 2011

(54) AERATING WINE GLASS

(76) Inventor: Frank A. Lardino, Lemont, IL (US)

( * ) Notice: Subject to any disclaimer, the term of this patent is extended or adjusted under 35 U.S.C. 154(b) by 682 days.

(21) Appl. No.: 12/071,516

(22) Filed: Feb. 21, 2008

(65) Prior Publication Data

US 2009/0212053 A1 Aug. 27, 2009

(51) Int. Cl.
*A47G 19/22* (2006.01)

(52) U.S. Cl. ..... 220/703

(58) Field of Classification Search ..... 99/277.1, 99/277.2; 220/703, 719; 215/387, 386
See application file for complete search history.

(56) References Cited

U.S. PATENT DOCUMENTS 2,187,558 A * 1/1940 Kushima ..... 215/12.1
4,003,555 A 1/1977 Swartz
4,346,731 A * 8/1982 Sigworth, Jr. ..... 137/433
4,356,927 A 11/1982 Cooper et al.
4,437,576 A 3/1984 Barniak
4,690,294 A 9/1987 Jones
4,921,112 A * 5/1990 Juhlin et al. ..... 215/11.4
5,054,661 A 10/1991 Hollje
5,857,584 A 1/1999 Taggart
6,409,374 B1 6/2002 Willat
7,188,743 B1 3/2007 Gates et al.
2006/0032855 A1 2/2006 Hinkle
2006/0249518 A1 11/2006 Festa
2007/0257048 A1 * 11/2007 Towery et al. ..... 220/703

* cited by examiner

*Primary Examiner* — Stephen J. Castellano
(74) *Attorney, Agent, or Firm* — Richard C. Litman

(57) ABSTRACT

The aerating wine glass is a beverage glass having a fluid dynamic structure formed on an inner surface thereof for generating bubbles in the beverage when the beverage is swirled therein. The aerating wine glass is preferably formed as a conventional wine glass, having a receptacle portion, a stem, and a base, with the receptacle portion having an open upper end and a closed lower end. A plurality of protruding members are formed on an inner surface of the receptacle portion so that swirling the beverage received within the receptacle portion causes the beverage to pass over the plurality of protruding members in order to aerate the beverage through the production of air bubbles. Each protruding member may be formed as a hollow tube, allowing the wine to travel both over and through the protruding member in order to generate air bubbles as the wine is swirled.

17 Claims, 4 Drawing Sheets

AERATING WINE GLASS

BACKGROUND OF THE INVENTION

1. Field of the Invention

The present invention relates to glassware, and particularly to an aerating wine glass for aerating wine when the wine is swirled therein.

2. Description of the Related Art

Wine is often allowed to "breathe" prior to consumption. Allowing wine to breathe, or aerate, maximizes the wine's exposure to the surrounding air. By allowing wine to mix and mingle with air, the wine will typically warm up and the wine's aromas will "open", allowing the flavor profile to soften and mellow, thus improving the overall flavor characteristics of the wine.

In order to allow a wine to properly aerate, users often pour the wine from a bottle into a special decanter, and let the wine remain in the decanter prior to pouring into the wine glasses. The aeration takes place through exposure of the wine to the ambient air. However, such aeration only takes place along the surface of the wine, and is therefore minimal and may take an extended period of time for any noticeable effect.

Once the wine is poured into wine glasses, drinkers often swirl the wine in the glass, both to savor the aroma of the wine and also to provide further aeration. However, the aeration caused by the swirling of the wine over a smooth surface within the glance is also minimal. Thus, it would be desirable to provide a glass that maximizes aeration within the wine, without requiring the user to wait for extended periods of time before drinking the wine.

Thus, an aerating wine glass solving the aforementioned problems is desired.

SUMMARY OF THE INVENTION

The aerating wine glass is a beverage glass having a fluid dynamic structure formed on an inner surface thereof for generating bubbles in the beverage when the beverage is swirled therein. The aerating wine glass is preferably formed as a conventional wine glass, having a receptacle portion, a stem, and a base, with the receptacle portion having an open upper end and a closed lower end. A plurality of protruding members are formed on an inner surface of the receptacle portion so that swirling the beverage in the receptacle portion causes the beverage to pass over the plurality of protruding members in order to aerate the beverage through the production of air bubbles. Further, the plurality of protruding members increase the interior surface area of the glass, thus increasing the surface area of the liquid as the liquid is passed over the protrusions. This increased surface area increases the contact area between the liquid and the air, thus increasing the rate of aeration.

Each protruding member may be formed as a hollow tube having a substantially cylindrical contour. Alternatively, the protruding members may be spherical, or have any other shape that would aid in circulating air through the wine. It should be understood that the tubular and spherical contouring are provided for exemplary purposes only, and that the protruding members may have any desired contouring or dimensions.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
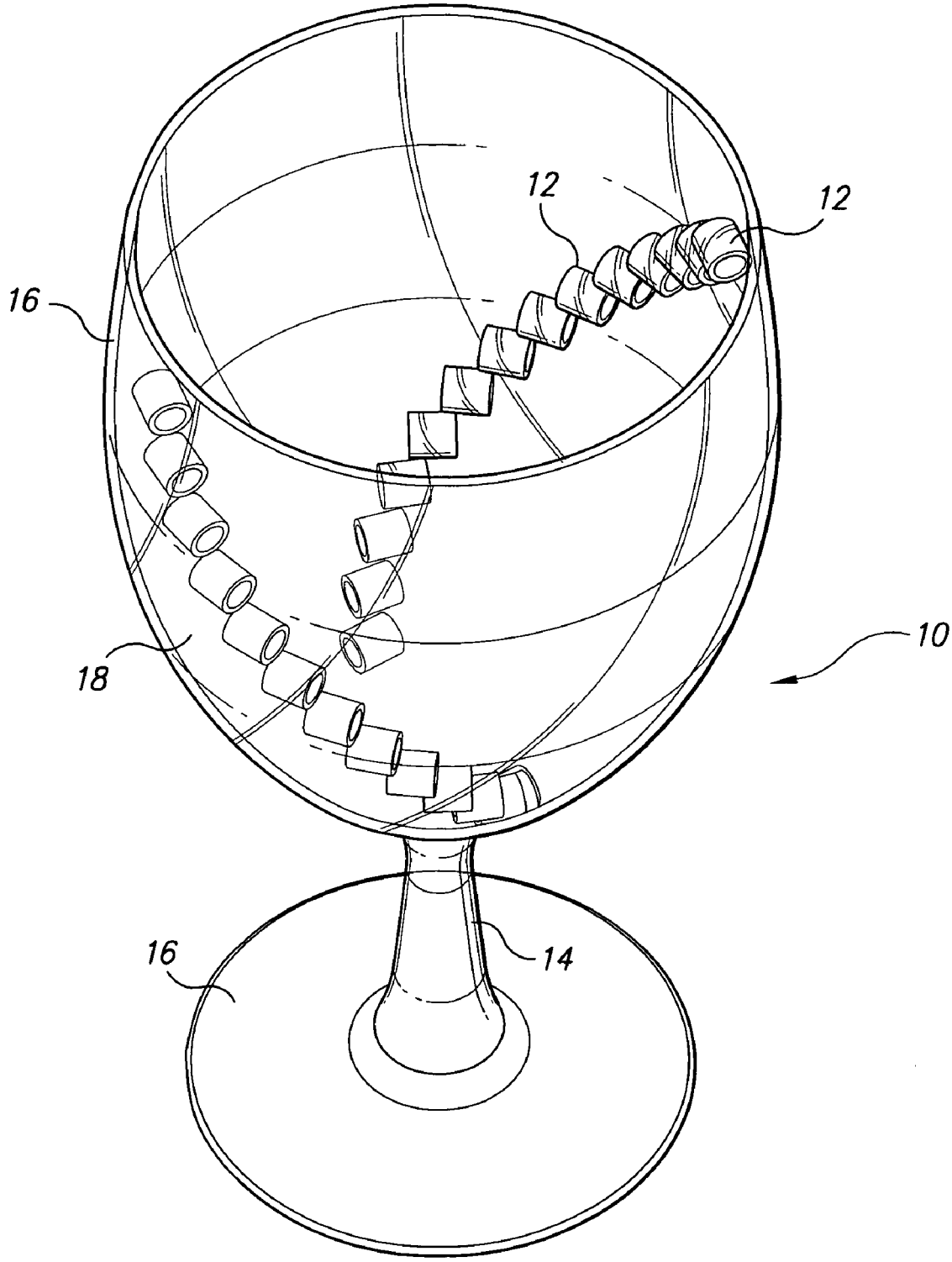
FIG. 1 is a perspective view of a first embodiment of an aerating wine glass according to the present invention.

The present invention is directed towards an aerating wine glass 10. The aerating wine glass 10 is a beverage glass having a fluid dynamic structure formed on an inner surface thereof for generating bubbles in the beverage when the beverage is swirled therein. The aerating wine glass 10 is preferably formed as a conventional wine glass, having a receptacle portion 16, a stem 14, and a base 16. The receptacle portion 16 has an open upper end and a closed lower end. It should be understood that the fluid dynamic structure formed on the inner surface of the receptacle portion 16 may be applied to glasses having other configurations, and is not limited to wine glasses.

A plurality of protruding members 12 are formed on an inner surface 20 of the receptacle portion 16 so that swirling the beverage in the receptacle portion 16 causes the beverage to pass over the plurality of protruding members 12 in order to aerate the beverage through the production of air bubbles. Further, the plurality of protruding members 12 increase the interior surface area of the glass, thus increasing the surface area of the liquid as the liquid is passed over the protrusions 12. This increased surface area increases the contact area between the liquid and the air, thus increasing the rate of aeration. The protruding members 12 are preferably formed of glass and may be integrally formed with the receptacle portion during the manufacture thereof. Protruding members 12 may, alternatively, be attached to the inner surface 20 by adhesive or the like.

Each protruding member 12 may be formed as a hollow tube having a substantially cylindrical contour. However, each protruding member 12 Alternatively, the protruding members may be spherical, as described below, or may have any other shape that would aid in circulating air through the wine.

Figure 2:
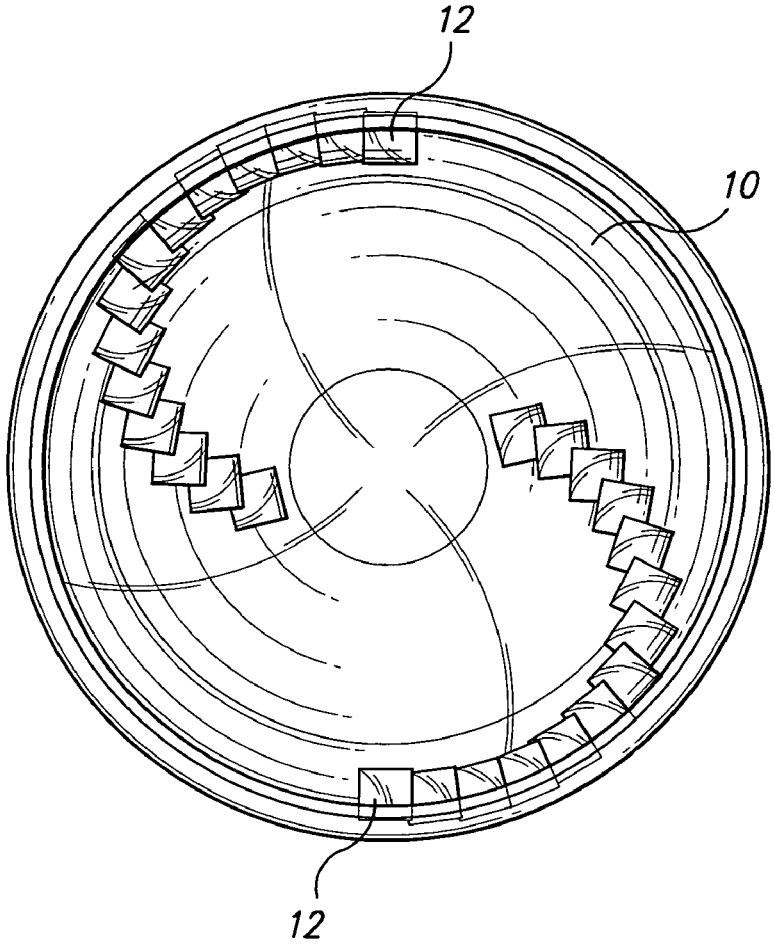
FIG. 2 is a top view of the aerating wine glass of FIG. 1.
Figure 3:
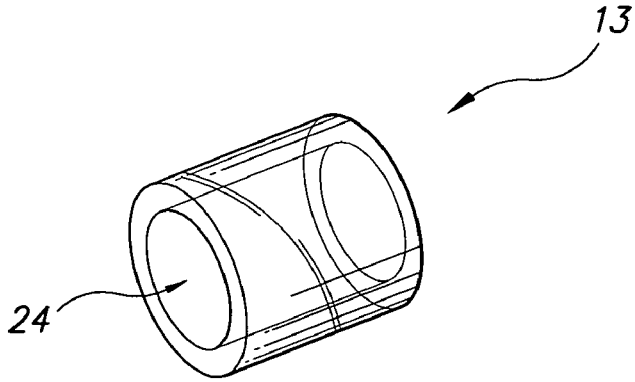
FIG. 3 is a perspective view of an exemplary protruding member of the aerating wine glass of FIG. 1.

In the embodiment of FIGS. 1 and 2, each of the protruding members is formed as a hollow tube 12. As shown in FIG. 3, each hollow tube 12 preferably has a substantially cylindrical contour formed from a hollow cylindrical shell 22 with a passage 24 formed therethrough. When a beverage, such as wine, is swirled within the upper receptacle portion 16, the wine passes both over and around the shell 22 of tube 12, and also through the passage 24. The passage of the wine over and through each tube 12 creates complex fluid flow within the receptacle portion, generating vortices and turbulence within the fluid medium, which results in the production of air bubbles therein, thus aerating the wine as it is swirled.

As shown, the plurality of protruding members 12 may be positioned to extend from a lower region of the inner surface 20 of the receptacle portion 16 to an upper region of the inner surface of the receptacle portion 16 (approximately the liquid level of a full glass of wine). This allows for aeration throughout the entire volume of wine filling the receptacle portion 16.

As best shown in FIG. 2, the protruding members 12 may be divided into first and second sets of protruding members, with the first and second sets of protruding members 12 being positioned on diametrically opposed portions of the inner surface 20. By providing two or more separate sets of protruding members 12, the aeration of the wine (through production of bubbles created by passing around and through the hollow tubes 12) is enhanced. In FIG. 2, the first and second sets of protruding members 12 are shown arrayed in substantially helical patterns. It should be understood that any suitable number of protruding members 12 may be provided, any suitable number of separate sets of protruding members 12 may be provided, and the protruding members 12 may be arrayed in any desired pattern, depending upon the shape of the glass and aesthetic preference.

Figure 4:
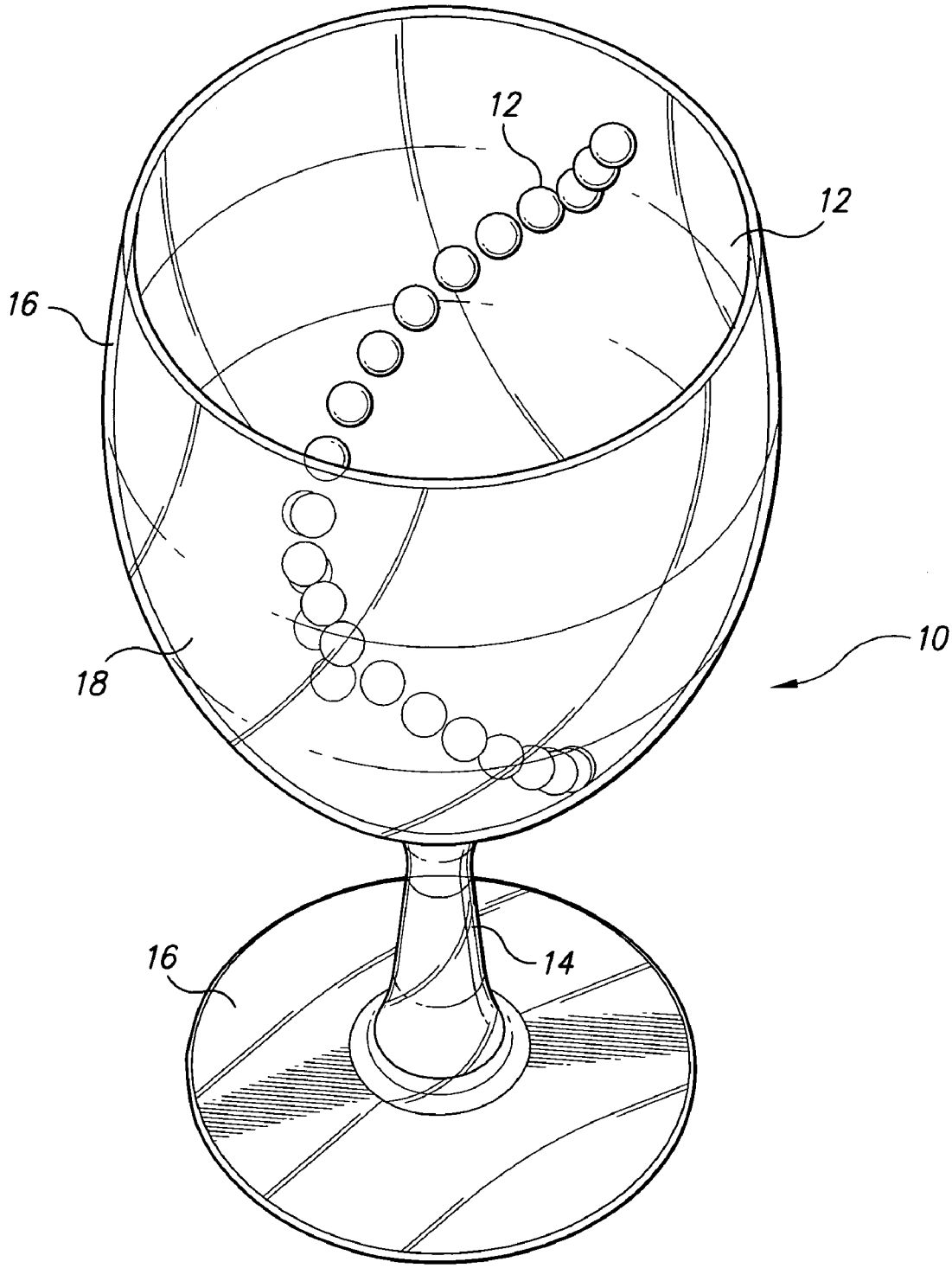
FIG. 4 is a perspective view of an alternative embodiment of an aerating wine glass according to the present invention.
Figure 5:
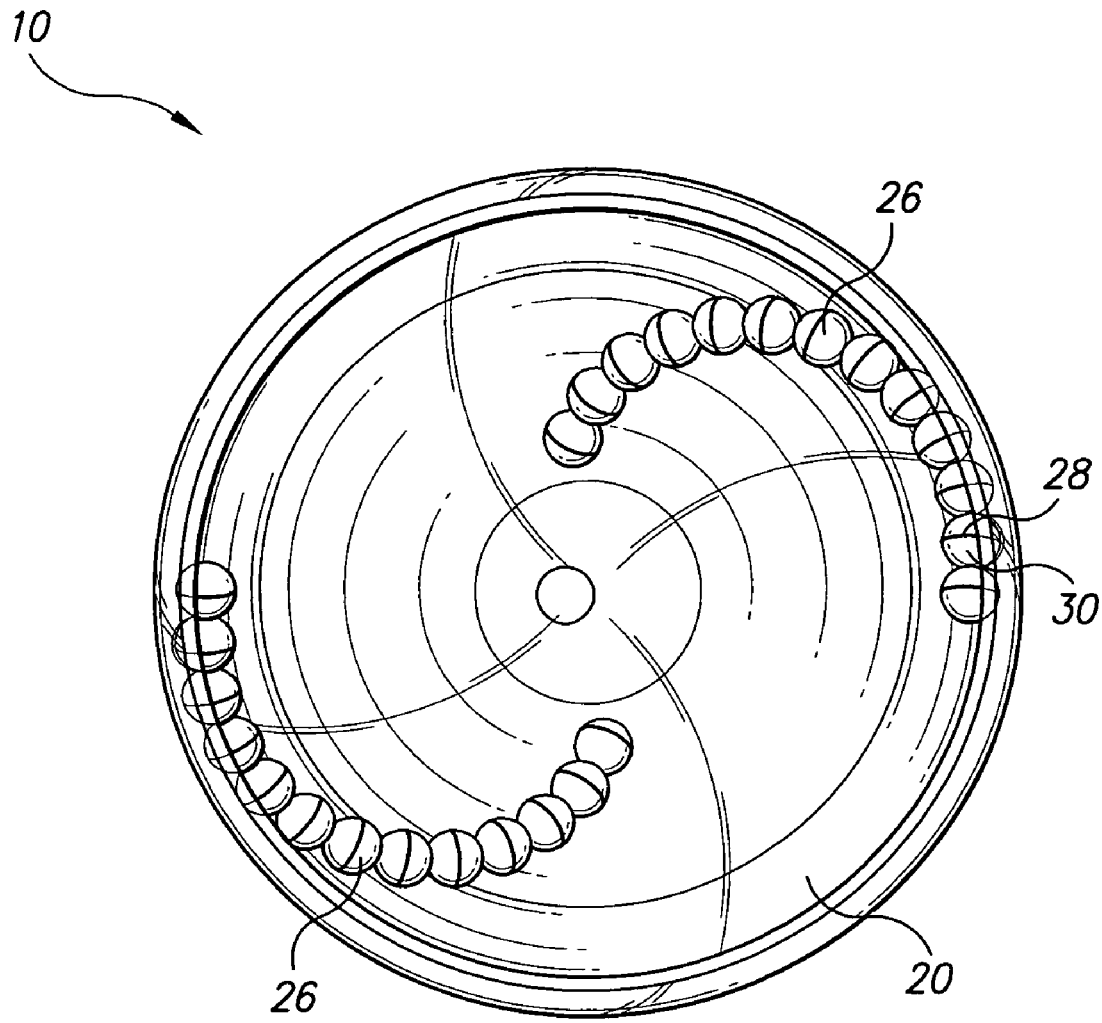
FIG. 5 is a top view of the aerating wine glass of FIG. 4.

In the embodiment of FIGS. 4 and 5, the hollow tubes 12 have been replaced by substantially spherical members 26. It should be understood that the protruding members 26 may have any desired shape that will produce sufficient aeration, and that the spherical members 26 are shown for exemplary purposes only. The substantially spherical protruding members 26 are positioned and arrayed in a manner similar to hollow tubes 12. As best shown in FIG. 5, each of the spherical protruding members 26 may include two separate regions 28, 30, with each region being formed from a separately colored glass, to provide a dual-hue aesthetic effect. It should be understood that the tubular and spherical contouring are provided for exemplary purposes only, and that the protruding members may have any desired contouring or dimensions.

It is to be understood that the present invention is not limited to the embodiments described above, but encompasses any and all embodiments within the scope of the following claims.

I claim:

1. An aerating wine glass, comprising:

a receptacle portion having an open upper end and a closed lower end, the receptacle portion being adapted for containing wine; and a plurality of protruding members formed on an inner surface of the receptacle portion, said plurality of protruding members being arrayed in a substantially helical pattern, whereby swirling the wine in the receptacle portion causes the wine to pass over the plurality of protruding members in order to aerate the wine.

2. The aerating wine glass as recited in claim 1, wherein each of said plurality of protruding members comprises a hollow tube.

3. The aerating wine glass as recited in claim 2, wherein each of said hollow tubes is substantially cylindrical.

4. The aerating wine glass as recited in claim 1, wherein each of said plurality of protruding members is spherical.

5. The aerating wine glass as recited in claim 4, wherein each of said protruding members is formed from glass.

6. The aerating wine glass as recited in claim 5, wherein each of said protruding members has first and second regions, each of the first and second regions being formed from a glass having a separate and distinct hue.

7. The aerating wine glass as recited in claim 1, wherein said plurality of protruding members extend from a lower region of the inner surface of the receptacle portion to an upper region of the inner surface of the receptacle portion.

8. The aerating wine glass as recited in claim 1, wherein said plurality of protruding members comprise first and second sets of protruding members, the first and second sets of protruding members being disposed on diametrically opposed portions of the inner surface.

9. The aerating wine glass as recited in claim 1, further comprising:

a base having opposed upper and lower surfaces, the lower surface being adapted for mounting on a support surface; and a stem having opposed upper and lower ends, the lower end thereof being joined to the upper surface of the base, the upper end thereof being joined to the closed lower end of the receptacle portion.

10. An aerating wine glass, comprising:

a receptacle portion having an open upper end and a closed lower end, the receptacle portion being adapted for containing wine; and a plurality of protruding members formed on an inner surface of the receptacle portion, said plurality of protruding members extending from a lower region of the inner surface of the receptacle portion to an upper region of the inner surface of the receptacle portion, said plurality of protruding members further extending circumferentially along the inner surface of the receptacle portion, wherein said plurality of protruding members are arrayed in a substantially helical pattern whereby swirling the wine in the receptacle portion causes the wine to pass over the plurality of protruding members in order to aerate the wine.

11. The aerating wine glass as recited in claim 10, wherein each of said plurality of protruding members comprises a hollow tube.

12. The aerating wine glass as recited in claim 11, wherein each of said hollow tubes is substantially cylindrical.

13. The aerating wine glass as recited in claim 10, wherein each of said plurality of protruding members is spherical.

14. The aerating wine glass as recited in claim 13, wherein each of said protruding members is formed from glass.

15. The aerating wine glass as recited in claim 14, wherein each of said protruding members has first and second regions, each of the first and second regions being formed from a glass having a separate and distinct hue.

16. The aerating wine glass as recited in claim 10, wherein said plurality of protruding members comprise first and second sets of protruding members, the first and second sets of protruding members being disposed on diametrically opposed portions of the inner surface.

17. The aerating wine glass as recited in claim 10, further comprising:

a base having opposed upper and lower surfaces, the lower surface being adapted for mounting on a support surface; and a stem having opposed upper and lower ends, the lower end thereof being joined to the upper surface of the base, the upper end thereof being joined to the closed lower end of the receptacle portion.

* * * * *